US011238829B2

(12) United States Patent
Shan

(10) Patent No.: US 11,238,829 B2
(45) Date of Patent: Feb. 1, 2022

(54) LUMINNANCE-VERSUS-DRIVE SIGNAL CURVE BASED METHOD FOR DRIVING DISPLAY PANEL, AND DISPLAY DEVICE

(71) Applicant: HKC Corporation Limited, Shenzhen (CN)

(72) Inventor: Jianfeng Shan, Shenzhen (CN)

(73) Assignee: HKC Corporation Limited, Shenzhen (CN)

( * ) Notice: Subject to any disclaimer, the term of this patent is extended or adjusted under 35 U.S.C. 154(b) by 41 days.

(21) Appl. No.: 16/755,522

(22) PCT Filed: Nov. 9, 2017

(86) PCT No.: PCT/CN2017/110229
§ 371 (c)(1),
(2) Date: Apr. 10, 2020

(87) PCT Pub. No.: WO2019/071698
PCT Pub. Date: Apr. 18, 2019

(65) Prior Publication Data

US 2021/0193077 A1 Jun. 24, 2021

(30) Foreign Application Priority Data

Oct. 10, 2017 (CN) ..... 201710937003.1

(51) Int. Cl.
*G09G 5/10* (2006.01)
*G09G 3/36* (2006.01)

(52) U.S. Cl.
CPC ..... *G09G 5/10* (2013.01); *G09G 3/3607* (2013.01); *G09G 2320/0233* (2013.01)

(58) Field of Classification Search
CPC ..... G09G 5/10; G09G 3/3607; G09G 3/36; G09G 2320/0233
See application file for complete search history.

(56) References Cited

U.S. PATENT DOCUMENTS

2017/0154587 A1* 6/2017 Chen ..... G09G 3/3607
2017/0330520 A1* 11/2017 Tien ..... G09G 3/3648
2020/0184911 A1* 6/2020 Chen ..... G09G 3/3625
2020/0357323 A1* 11/2020 Shan ..... G09G 5/026

* cited by examiner

*Primary Examiner* — Kwang-Su Yang
(74) *Attorney, Agent, or Firm* — Wang Law Firm, Inc.

(57) ABSTRACT

A driving method of a display panel and a display device using the same. The driving method includes: obtaining a drive signal of each of sub-pixels on the display panel; determining a first adaptive threshold and a second adaptive threshold according to properties of the sub-pixels; and adjusting the drive signal higher than the first adaptive threshold and lower than the second adaptive threshold, to approach an interval lower than the first adaptive threshold or an interval higher than the second adaptive threshold.

13 Claims, 11 Drawing Sheets

LUMINNANCE-VERSUS-DRIVE SIGNAL CURVE BASED METHOD FOR DRIVING DISPLAY PANEL, AND DISPLAY DEVICE

CROSS-REFERENCE TO RELATED APPLICATION

This application claims the benefit of China Patent Application No. 201710937003.1, filed on Oct. 10, 2017, in the State Intellectual Property Office of the People's Republic of China, the disclosure of which is incorporated herein in its entirety by reference.

BACKGROUND

1. Field

The present disclosure generally relates to a display technology, more particularly to a driving method of a display panel and a display device using the same.

2. Description of the Related Art

Large-size liquid crystal display panels usually apply negative Vertical Alignment (VA) liquid crystal technology or In-Plane Switching (IPS) liquid crystal technology. Compared with the IPS liquid crystal technology, VA liquid crystal technology has advantages in higher production efficiency and low manufacturing cost, but has worse optical property, particularly, in business application in which a larger view angle is required.

In larger view angle, tendency of brightness saturation of sub-pixels in the VA liquid crystal display panel quickly increases, that is, the curve tends to become flat. Particularly, when being driven by the middle or low drive voltage, brightness saturation occurs quickly, contrast of display decreases, so washout effect significantly occurs on the panel when being viewed under mixed view angles, that is, the screen image becomes whiter, and brightness of panel cannot linearly vary according to the drive voltage.

SUMMARY

In order to solve the problem of washout effect, the present disclosure is to provide a driving method of a display panel and a display device using the same.

According to an embodiment, the present disclosure provides a driving method of a display panel, and according to a luminance-versus-drive-signal curve under a side view angle of the display panel, when a drive signal is lower than a first adaptive threshold, higher than a second adaptive threshold, or between the first adaptive threshold and the second adaptive threshold, respectively, a slope of a tangent line on the luminance-versus-drive-signal curve is higher than a preset slope threshold, higher than the preset slope threshold, or lower than the preset slope threshold. The driving method includes steps of: obtaining the drive signal of each of sub-pixels on the display panel; determining the first adaptive threshold and the second adaptive threshold according to the properties of the sub-pixels; and adjusting the drive signal higher than the first adaptive threshold and lower than the second adaptive threshold, to approach an interval lower than the first adaptive threshold or an interval higher than the second adaptive threshold.

According to an embodiment, the present disclosure provides a display device including a panel and a driver chip. According to a luminance-versus-drive-signal curve under a side view angle of the display panel, when the drive signal is lower than a first threshold, higher than a second threshold, or between the first threshold and the second threshold, respectively, the slope of the tangent line is higher than the preset slope threshold, higher than the preset slope threshold, or lower than the preset slope threshold. The driver chip is configured to obtain the drive signal of each of sub-pixels on the display panel, and determine a first adaptive threshold and a second adaptive threshold according to properties of the sub-pixels, and then adjust the drive signal higher than the first adaptive threshold and lower than the second adaptive threshold to approach the interval lower than the first adaptive threshold or the interval higher than the second adaptive threshold.

According to an embodiment, the present disclosure provides a driving method of a display panel. According to a luminance-versus-drive-signal curve under a side view angle of the display panel, when a drive signal is lower than a first adaptive threshold, higher than a second adaptive threshold, or between the first adaptive threshold and the second adaptive threshold, respectively, a slope of a tangent line on the luminance-versus-drive-signal curve is higher than a preset slope threshold, higher than the preset slope threshold, or lower than the preset slope threshold, and the driving method includes steps of: obtaining the drive signal of each of sub-pixels on the display panel; grouping the sub-pixels of the display panels into a plurality of sub-pixel sets, wherein each sub-pixel set comprises the red sub-pixels, the green sub-pixels and the blue sub-pixels, and the numbers of the red sub-pixels, the green sub-pixels and the blue sub-pixels are the same; respectively calculating a first average drive signal of red sub-pixels, a second average drive signal of green sub-pixels, and a third average drive signal of blue sub-pixels in each sub-pixel set; calculating parameters of the sub-pixel set in a color space system according to the first average drive signal, the second average drive signal and the third average drive signal; when the parameters are located in different intervals, determining different first adaptive thresholds and second adaptive thresholds of the red sub-pixels of the sub-pixel set, determining different first adaptive thresholds and second adaptive thresholds of the green sub-pixels of the sub-pixel set, and determining different first adaptive thresholds and second adaptive thresholds of the blue sub-pixels of the sub-pixel set, wherein the parameters comprise values of saturation and hue; increasing the drive signal higher than the average drive signal, by a first preset value, when it is determined that the average drive signal is higher than the first adaptive threshold of the corresponding color sub-pixel and lower than the second adaptive threshold of the corresponding color sub-pixel, wherein the average drive signal is the first average drive signal when the corresponding color sub-pixel is the red sub-pixel, the average drive signal is the second average drive signal when the corresponding color sub-pixel is the green sub-pixel, and the average drive signal is the third average drive signal when the corresponding color sub-pixel is the blue sub-pixel.

According to above-mentioned driving method and display device, after the drive signals of sub-pixels on the display panel are obtained and the first adaptive threshold and the second adaptive threshold are determined according to properties of the sub-pixels, the drive signal higher than the first adaptive threshold and lower than the second adaptive threshold are adjusted to approach an interval lower than the first adaptive threshold or an interval higher than the second adaptive threshold. As a result, the magnitudes of the drive signals can be adaptively adjusted according to properties of the sub-pixels, to enter the interval where the slope of the curve is larger, from the interval where brightness situation occurs, thereby preventing brightness situation and improving contrast under the larger view angle, reducing the washout effect.

BRIEF DESCRIPTION OF THE DRAWINGS

The structure, operating principle and effects of the present disclosure will be described in detail by way of various embodiments which are illustrated in the accompanying drawings.

DETAILED DESCRIPTION OF THE PREFERRED EMBODIMENTS

Figure 1:
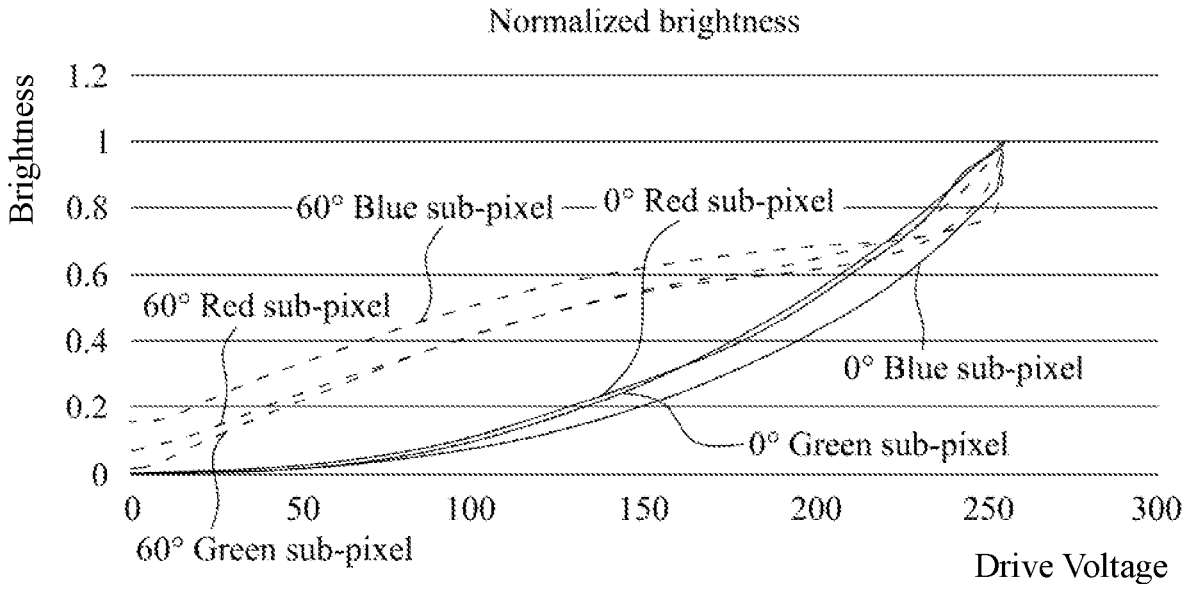
FIG. 1 shows brightness-versus-drive-voltage curves of sub-pixel under 0 degree of view angle and 60 degrees of view angle.

The following embodiments of the present disclosure are herein described in detail with reference to the accompanying drawings. These drawings show specific examples of the embodiments of the present disclosure. It is to be understood that these embodiments are exemplary implementations and are not to be construed as limiting the scope of the present disclosure in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

FIG. 1 shows a brightness brightness-versus-drive-voltage curve of the VA liquid crystal display panel. In FIG. 1, the horizontal axis is drive voltage, and the longitudinal axis is brightness, the solid line is curve corresponding to 0 degree of side view angle, and the dashed line is curve of 60 degrees of side view angle. As shown in FIG. 1, tendency of brightness saturation of each sub-pixel under the 60 degrees of side view angle quickly increases, that is, the curve tends to flat. Particularly, under the middle or low drive voltage, brightness saturation occurs quickly and brightness contrast between pixels decreases, so that washout effect significantly occurs on the panel when being viewed under mixed view angles; that is, the screen image becomes whiter and brightness of the pixel cannot linearly vary according to the drive voltage.

In order to overcome the washout effect, an embodiment of the present disclosure provides a driving method of a display panel. The driving method can be executed by a driver chip, and the drive chip can be configured to drive the display panel to display an image. The display panel can be, but not limited to, Twisted Nematic (TN) type liquid crystal display panel, Optically Compensated Birefringence (OCB) type liquid crystal display panel, the VA type liquid crystal display panel, curved liquid crystal display panel, or the like.

In the embodiment, according to the luminance-versus-drive-signal curve under a side view angle of the display panel, when the drive signal is lower than a first threshold, higher than a second threshold, or between the first threshold and the second threshold, respectively, the slope of tangent line on the luminance-versus-drive-signal curve is higher than a preset slope threshold, higher than the preset slope threshold, or lower than the preset slope threshold.

Figure 7:
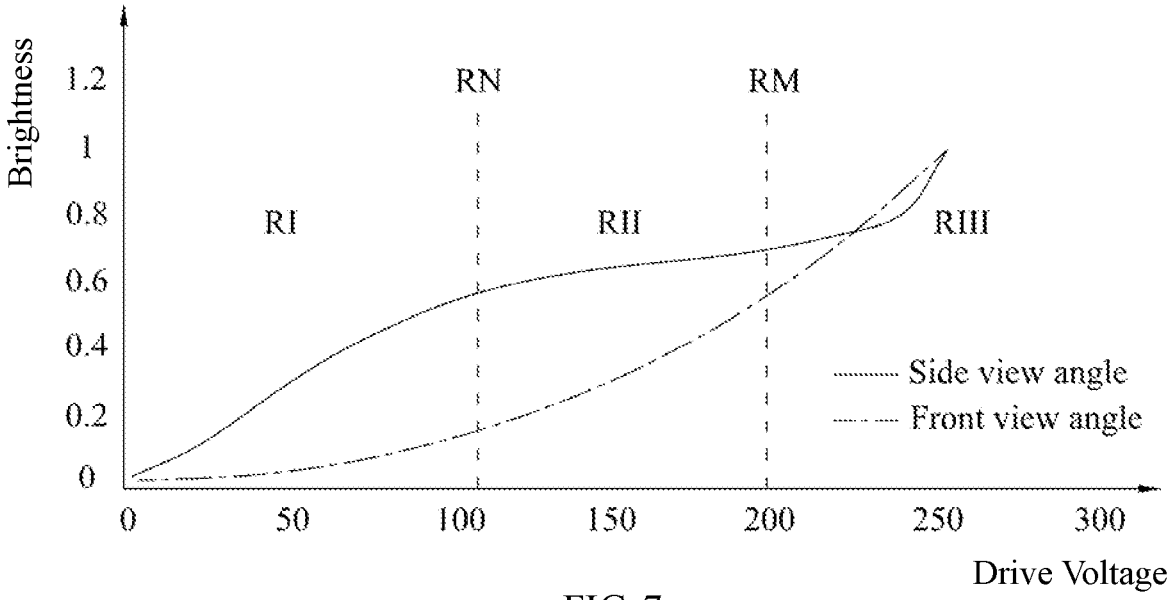
FIG. 7 shows brightness-versus-drive-signal curves of the red sub-pixel of the display panel, in accordance with the present disclosure.
Figure 8:
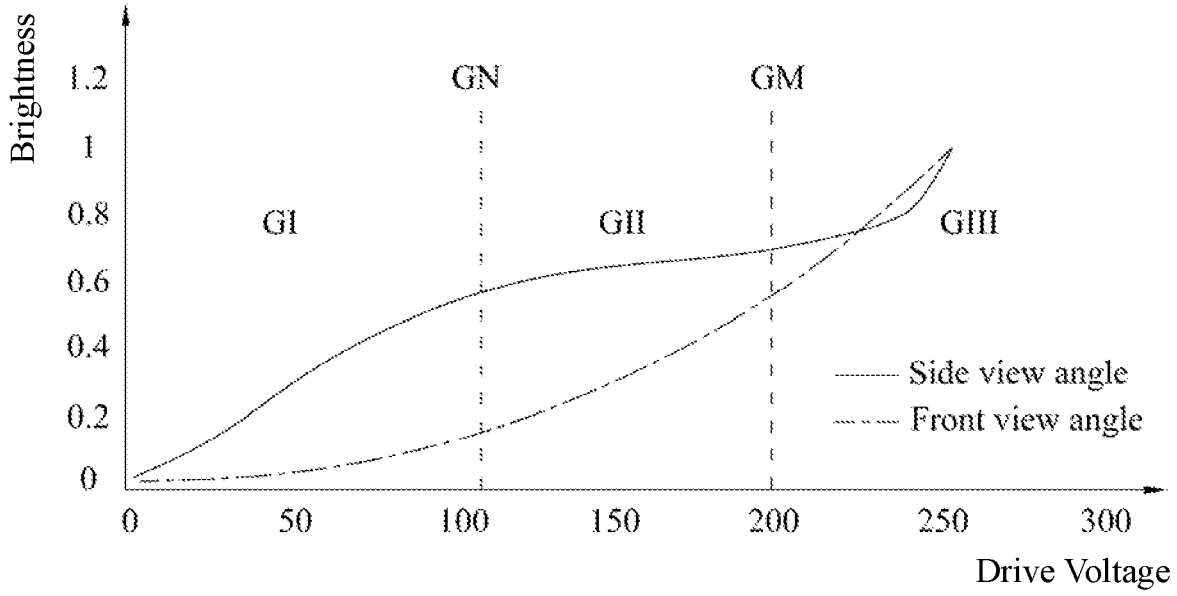
FIG. 8 shows brightness-versus-drive-signal curves of a green sub-pixel of the display panel, in accordance with the present disclosure.
Figure 9:
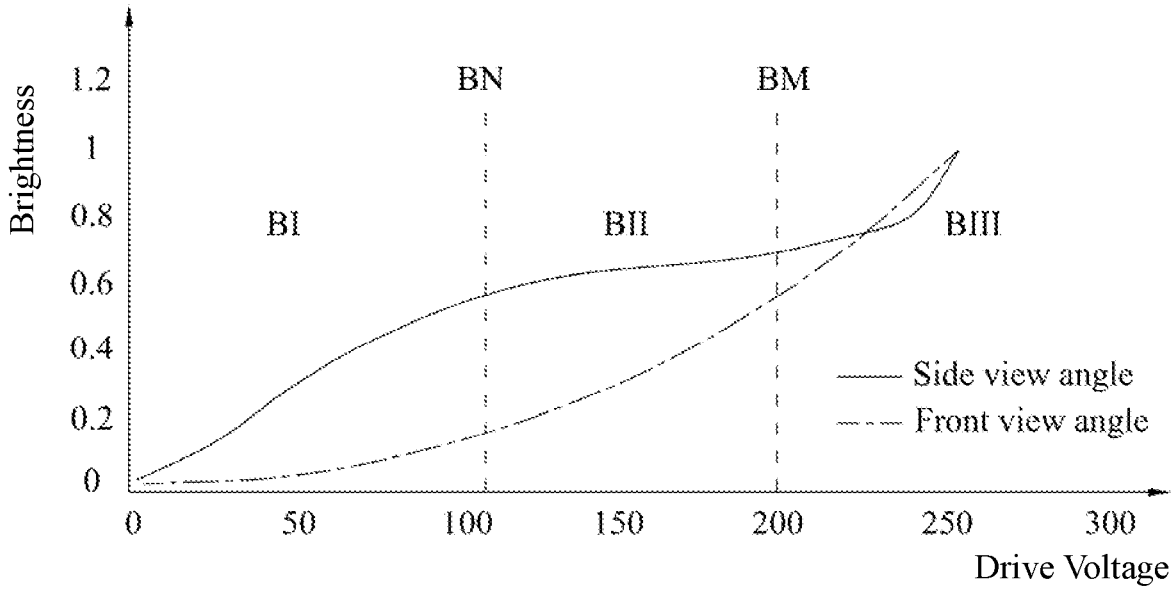
FIG. 9 shows brightness-versus-drive-signal curve of a blue sub-pixel of the display panel, in accordance with the present disclosure.

Please refer to FIGS. 7 through 9, which show brightness-versus-drive-signal curves of the red sub-pixel, the green sub-pixel, the blue sub-pixel under the side view angle and the front view angle, respectively. In FIG. 7, RN and RM are the first threshold and the second threshold corresponding to the red sub-pixel, respectively. The slopes of tangent lines of curve respectively within the RI interval and the RIII interval are higher than the preset slope threshold, and the slope of the tangent line of the curve within the RII interval is lower than the preset slope threshold, and the brightness within the RII interval trends to saturation. In FIG. 8, GN and GM are the first threshold and the second threshold corresponding to the green sub-pixel, respectively. The slopes of tangent lines of the curve within the GI interval and the GIII interval are higher than the preset slope threshold, respectively. The slope of the tangent line of the curve within the GII interval is lower than the preset slope threshold and the brightness within the GII interval trends to saturation. In FIG. 9, BN and BM are the first threshold and the second threshold corresponding to the blue sub-pixel, respectively. Slopes of tangent lines of curve respectively within the BI interval and the Bill interval are higher than the preset slope threshold. The slope of the tangent line of the curve within the BII interval is lower than the preset slope threshold, and the brightness within the BII interval trends to saturation.

Figure 2:
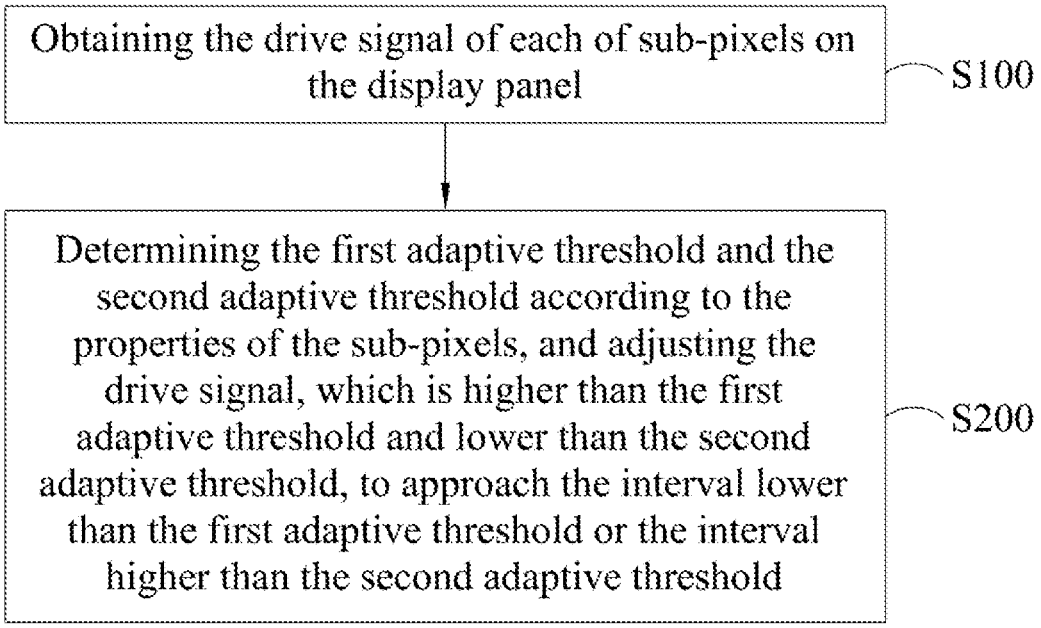
FIG. 2 is a flowchart showing the steps in an operation of a driving method of a display panel of an embodiment of the present disclosure.

Please refer to FIG. 2, which shows the driving method of the display panel of the present disclosure, and the driving method includes steps S100 and S200.

The step S100 is the step of obtaining the drive signal of each of sub-pixels on the display panel.

The drive signal can be the drive voltage provided by the driver chip to the display panel. For example, the sub-pixel can be a red sub-pixel, a green sub-pixel or a blue sub-pixel. In the step, the obtained drive signal can be the original drive signal. The original drive signals include the drive signal which may cause the brightness saturation. The objective of this embodiment is to adjust the magnitudes of the original drive signal, so as to prevent or reduce the effect of the brightness saturation.

The step S200 is a step of determining the first adaptive threshold and the second adaptive threshold according to the properties of the sub-pixels, and adjusting the drive signal, which is higher than the first adaptive threshold and lower than the second adaptive threshold, to approach the interval lower than the first adaptive threshold or the interval higher than the second adaptive threshold.

For example, the property of the sub-pixel can be saturation or hue of the sub-pixel. In other words, when the drive signal is within the interval where the drive signal is higher than the first threshold and lower than the second threshold, the drive signal is decreased to approach the interval lower than the first threshold, or the drive signal is increased to approach the interval higher than the second threshold. The red sub-pixel shown in FIG. 7 is taken as example. Suppose that RN and RM shown in FIG. 7 are a first adaptive threshold and a second adaptive threshold of the red sub-pixel, the drive signal at the left side within the interval RII can be decreased by a preset value, so as to enter or approach the interval RI; or, the drive signal at the right side of the interval RII can be increased by a preset value, so as to enter or approach the interval RI. As a result, after adjusted, the drive signals originally within the interval RII can enter or approach the interval RI and the interval RIII, so that the brightness-versus-drive signal curve under the side view angle becomes more linear.

If the properties of different areas of the display panel are different from each other, the brightness-versus-drive-signal curves corresponding to the same color sub-pixels in different areas are also different from each other, and the first threshold and second threshold which both define the brightness saturation interval, are also different. In this embodiment, the adaptive intervals of the brightness saturation in different areas can be determined according to the color features of different areas of the display panel, that is, the first adaptive thresholds and the second adaptive thresholds of the areas can be determined according to the color features of the areas, and then the drive signals of the sub-pixels of each areas are adjusted according to the first adaptive threshold and the second adaptive threshold, thereby solving and preventing the color shift effect occurred on different color pixels.

In the driving method of the display panel of the embodiment of the present disclosure, by the distribution of the drive signal is optimized, the drive signals of the sub-pixels are adaptively adjusted according to the properties of the sub-pixels, so that the drive signals of the sub-pixels can be adjusted to the interval where the brightness saturation occurs slightly or does not occur, and the brightness-versus-drive-signal curve can be varied more linearly, thereby preventing or reducing the washout effect on the display panel when the display panel is viewed under large view angle.

Specifically, the step S200 can be implemented by the following steps S210 and S220. Please refer to FIG. 3.

The step S210 is a step of grouping the sub-pixels of the display panels into a plurality of sub-pixel sets, and each sub-pixel set includes the red sub-pixels, the green sub-pixels and the blue sub-pixels, and the numbers of the red sub-pixels, the green sub-pixels and the blue sub-pixels are the same.

Figure 4:
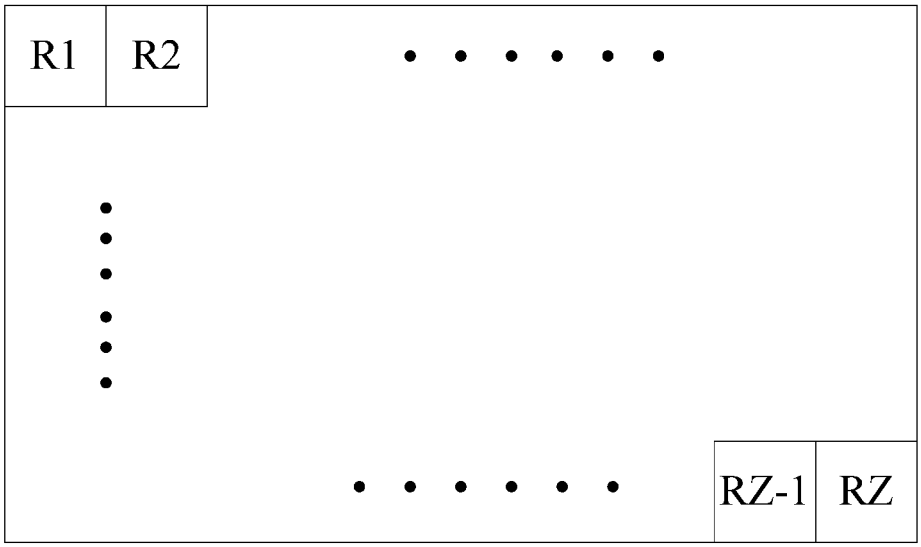
FIG. 4 is a schematic view of red sub-pixels on the display panel, in accordance with the driving method of display panel of FIG. 2.
Figure 5:
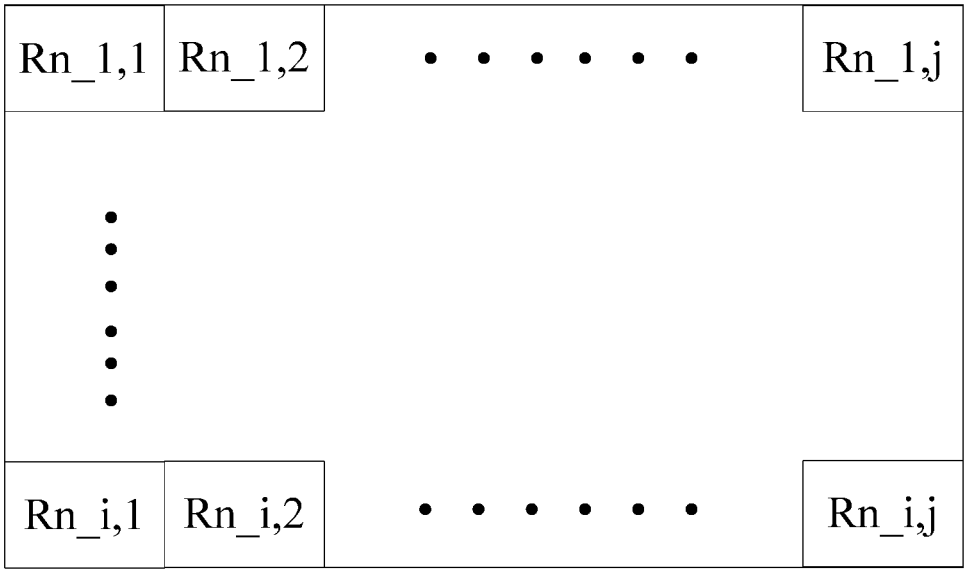
FIG. 5 is a schematic view of a red sub-pixel set on the display panel of FIG. 4.

In other words, the red sub-pixels on the display panel are grouped into a plurality of red sub-pixel sets, the green sub-pixels are grouped into a plurality of green sub-pixel sets, the blue sub-pixels are grouped into a plurality of blue sub-pixel sets, and each sub-pixel set includes a red sub-pixel set, a green sub-pixel set and a blue sub-pixel set. The red sub-pixel is taken as example for illustration. Please refer to FIG. 4. All red sub-pixels on the display panel are grouped into Z red sub-pixel sets, R1, R2, . . . , RZ. Please refer to FIG. 5. Each red sub-pixel set includes a plurality of red sub-pixels Rn_1,1, Rn_1,2, . . . Rn_i,j.

The step S220 is a step of determining the first adaptive threshold and the second adaptive threshold of each sub-pixel set according to properties of sub-pixels included in each sub-pixel set, and then adjusting the drive signal, which is higher than the first adaptive threshold and lower than the second adaptive threshold, to approach the interval lower than the first adaptive threshold or the interval higher than the second adaptive threshold.

In a sub-pixel set, each of the red sub-pixel, the green sub-pixel and the blue sub-pixel has the first adaptive threshold and the second adaptive threshold corresponding thereto. Furthermore, each of the same color sub-pixels (such as red sub-pixel) also has the first adaptive threshold and the second adaptive threshold corresponding thereto.

After the first adaptive threshold and the second adaptive threshold corresponding to each of the color sub-pixels of the sub-pixel set are determined, the optimization for the distribution of the drive signals of the sub-pixel set can be performed. For the red sub-pixels of the sub-pixel set, the drive signal of the red sub-pixel can be adjusted according to the first threshold RN and the second threshold RM shown in FIG. 7; suppose that RN and RM shown in FIG. 7 are the first adaptive threshold and the second adaptive threshold of the red sub-pixel. The drive signal of the green sub-pixel set can be adjusted according to the first threshold GN and the second threshold GM shown in FIG. 7; suppose that GN and GM shown in FIG. 8 are the determined first adaptive threshold and the second adaptive threshold of the green sub-pixel, respectively. The drive signal of the blue sub-pixel can be adjusted according to the first threshold BN and the second threshold BM shown in FIG. 9; suppose that BN and BM shown in FIG. 9 are the determined first adaptive threshold and the second adaptive threshold of the blue sub-pixel, respectively.

In this embodiment, the sub-pixels of the display panel are grouped into the plurality of sub-pixel sets, to facilitate to independently perform signal processing on each sub-pixel set, thereby effectively processing the brightness properties of local sub-pixels. Furthermore, when a number of the sub-pixel sets of the display panel is more, the precision of the signal processing becomes higher, so that the image quality of the display panel is better. A number of the grouped sub-pixel set can be adjusted according to practical condition, thereby extending the usage scope of the driving method of the present disclosure.

Specifically, in the step S220, for each sub-pixel set, the step of determining the first adaptive threshold and the second adaptive threshold according to the properties of the sub-pixels can be implemented by steps S221, 222 and 223. Please refer to FIG. 6.

The step S221 is a step of calculating a first average drive signal of the red sub-pixels of each sub-pixel set, a second average drive signal of the green sub-pixels of each sub-pixel set, and a third average drive signal of the blue sub-pixels of each sub-pixel set.

The first average drive signal is a mean value of the drive signals of all red sub-pixels of the sub-pixel set. The second average drive signal is a mean value of the drive signals of all green sub-pixels of the sub-pixel set. The third average drive signal is a mean value of the drive signals of all blue sub-pixels of the sub-pixel set. In each sub-pixel set, for example, the drive signals of a part of the red sub-pixels are higher than the first average drive signal, and the drive signals of other part of the red sub-pixels are lower than the first average drive signal.

The first average drive signal Rn', the second average drive signal Gn', and the third average drive signal Bn' are:

$$Rn'=\text{Average}(Rn_1,1,Rn_1,2,\ldots Rn_2,1,Rn_2,2,\ldots,Rn_i,j);$$

$$Gn'=\text{Average}(Gn_1,1,Gn_1,2,\ldots Gn_2,1,Gn_2,2,\ldots,Gn_i,j);$$

$$Bn'=\text{Average}(Bn_1,1,Bn_1,2,\ldots Bn_2,1,Bn_2,2,\ldots,Bn_i,j)$$

wherein Rn_1,1, . . . Rn_i,j indicate the red sub-pixels, respectively; Gn_1,1, . . . , Gn_i,j indicate the green sub-pixels, respectively; Bn_1,1, . . . , Bn_i,j indicate the blue sub-pixels, respectively.

The step S222 is a step of calculating parameters of pixels in the color space system, according to the first average drive signal, the second average drive signal and the third average drive signal.

Figure 10:
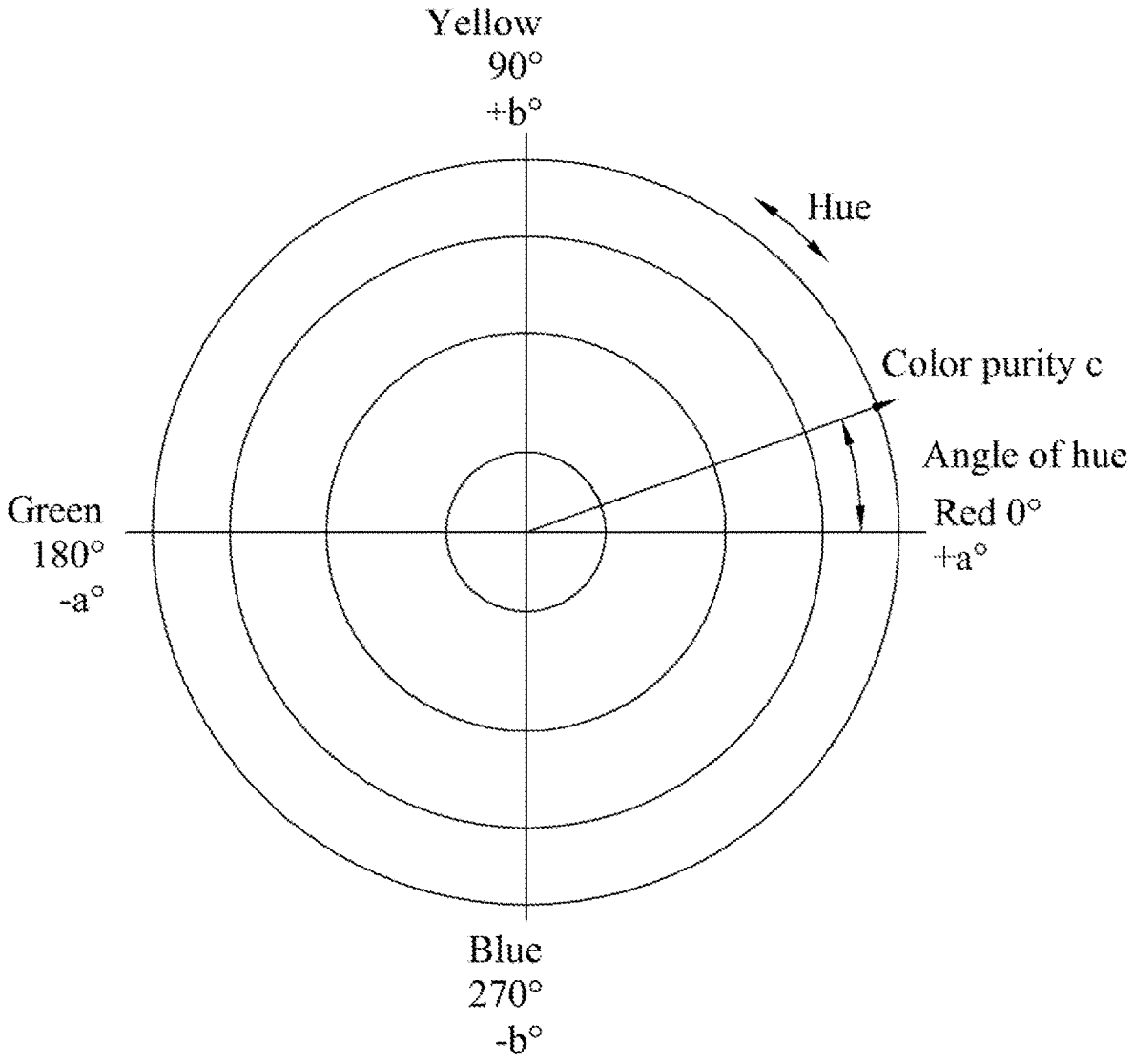
FIG. 10 is a schematic view of the CIE-LCH color space system.

For example, the color space system can be the CIE-LCH color space system. FIG. 10 shows the CIE-LCH color space system. In FIG. 10, L indicates brightness, C indicates saturation or color purity, and H indicates hue angle. A value of C is in a range of 0 to 100, and the color with C of 100 indicates that the color is the most colorful. The angle in a range of 0° to 360° indicates the color with different hue. The color with 0° of hue is red, the color with 90° of hue is yellow, the color with 180° of hue is green, and the color with 270° of hue is blue. Specifically, L=f1(R, G, B), C=f2(R, G, B), H=f3(R, G, B), and the CIE specification can provide the function relationship. According to the average drive signal of all color sub-pixels calculated in the step S221, the L, C, H of each sub-pixel set can be calculated. For example, H=f3(Rn', Gn', Bn'), C=f2(Rn', Gn', Bn').

Specifically, the parameters include values of saturation and hue.

In the step S223, when the parameters are located in different intervals, the red sub-pixel of the sub-pixel set is set to correspond to different first threshold and second threshold, and the green sub-pixel of the sub-pixel set is set to correspond different first threshold and second threshold, and the blue sub-pixel of the sub-pixel set is set to correspond to different first threshold and the second threshold.

Specifically, under a condition that the parameters include the values of saturation and hue, the value of hue can be divided into 6 different intervals; The first interval is: 0°<H≤45° and 315°, the second interval is: 45°<H≤135°, the third interval is: 135°<H≤205°, the fourth interval is: 205°<H≤245°, the fifth interval is: 245°<H≤295°, and the sixth interval is: 295°<H≤315°.

According to the divided intervals, the first threshold and the second threshold of different color sub-pixel of the sub-pixel set can be determined by following content.

1. when the values of hue H and saturation C satisfy following conditions:

$$0°<H\leq 45°\ \&\ 315°<H\leq 360°,\ \text{and}\ CTL1\leq C\leq CTH2$$

The first thresholds and the second thresholds of the red sub-pixel R, the green sub-pixel G, the blue sub-pixel B are: RN_1, RM_1, GN_1, GM_1, BN_1, BM_1.

2. when the values of hue H and saturation C satisfy following conditions:

$$45°<H\leq 135°,\ \text{and}\ CTL3\leq C\leq CTH4,$$

the first thresholds and the second thresholds corresponding to the red sub-pixel R, the green sub-pixel G and blue sub-pixel B respectively are: RN_2, RM_2, GN_2, GM_2, BN_2, BM_2.

3. When the values of hue H and saturation C satisfy following conditions:

$$135°<H\leq 205°,\ \text{and}\ CTL5\leq C\leq CTH6,$$

the first thresholds and the second thresholds of the red sub-pixel R, the green sub-pixel G, the blue sub-pixel B are: RN_3, RM_3, GN_3, GM_3, BN_3, BM_3.

4. When the values of hue and saturation satisfy following conditions:

$$205°<H\leq 245°,\ \text{and}\ CTL7\leq C\leq CTH8,$$

the first thresholds and the second thresholds of the red sub-pixel R, the green sub-pixel G, the blue sub-pixel B are: RN_4, RM_4, GN_4, GM_4, BN_4, BM_4.

5. When the values of hue H and saturation C satisfy following conditions:

$$245°<H\leq 295°,\ \text{and}\ CTL9\leq C\leq CTH10,$$

the first thresholds and the second thresholds of the red sub-pixel R, the green sub-pixel G, the blue sub-pixel B are: RN_5, RM_5, GN_5, GM_5, BN_5, BM_5.

6. When the values of hue H and saturation C satisfy following conditions:

$$295°<H\leq 315°,\ \text{and}\ CTL11\leq C\leq CTH12,$$

the first thresholds and the second thresholds of the red sub-pixel R, the green sub-pixel G, the blue sub-pixel B are: RN_6, RM_6, GN_6, GM_6, BN_6, BM_6.

The different intervals of C respectively are: CTL1≤C≤CTH2, CTL3≤C≤CTH4, CTL5≤C≤CTH6, CTL7≤C≤CTH8, CTL9≤C≤CTH10, and CTL11≤C≤CTH12.

In an embodiment, the first threshold and the second threshold RN, RM, GN, GM, BN, BM of different color sub-pixel of each sub-pixel set are determined according to parameters of the CIE-LCH color space system, thereby preventing and solving effect of color shift of different color.

Further, in the determination of the first threshold and the second threshold in the method of adjusting the drive signal, the step of adjusting the drive signal, which is higher than the first adaptive threshold and lower than the second adaptive threshold, to approach the interval lower than the first adaptive threshold or the interval higher than the second adaptive threshold, may specifically include following content.

When it is determined that the average drive signal is higher than the first adaptive threshold of the corresponding color sub-pixel and lower than the second adaptive threshold of the corresponding color sub-pixel, the drive signal, which is higher than the average drive signal, is increased by a first preset value. When the average drive signals is the first average drive signal, the second average drive signal, or the third average drive signal, the corresponding color sub-pixel is the red sub-pixel, the green sub-pixel, or the blue sub-pixel.

The red sub-pixel is taken as example. When it is determined that the first average drive signal is higher than the first adaptive threshold of the red sub-pixel and lower than the second adaptive threshold of red sub-pixel, the drive signal of the red sub-pixel is increased by the first preset value. Suppose that the first threshold RN and the second threshold RM of FIG. 7 are the determined adaptive thresholds according to the above-mentioned method, the red sub-pixels are arranged in a sequential order according to the magnitudes of the drive signals, from high to low, R1≥R2≥R3≥ . . . ≥R_i,j, wherein R1, R2, . . . , R_i,j indicates the drive signals corresponding to the red sub-pixels. Suppose that the drive signals of the first k red sub-pixels are higher than the first average drive signal, the drive signals of the k red sub-pixels are adjusted according to following equations:

$$R'1=R1+X1, R'2=R2'+X1, \ldots, R'k=Rk+X1$$

where X1 is the first preset value, R'1, R'2, . . . , R'k are the first k adjusted drive signals, respectively.

As shown in FIG. 7, when the first average drive signal is higher than the first threshold RN and lower than the second threshold RM, and the drive signals are not adjusted, the red sub-pixel higher than the first average drive signal in the sub-pixel set may have more serious brightness saturation under the large view angle, that is, a part of the red sub-pixels are located the interval RII or close to the interval RII. In this embodiment, the drive signals of these red sub-pixels are increased by the first preset value, so that the drive signals of the red sub-pixels can be adjusted into the interval RIII, or close to interval RIII, so that the brightness-versus-drive-signal curve can have higher linear resolution under the large view angle, thereby improving the brightness contrast between the red sub-pixels.

Specifically, for any color sub-pixel, the first preset value must satisfies the condition that the minimum drive signal of the drive signals higher than the average drive signal, plus the first preset value is higher than the second threshold corresponding the color sub-pixel. At this time, by adjusting the drive signal, the drive signals of the color sub-pixels higher than the average drive signal can be moved to the interval RIII. Furthermore, the first preset value can be adjusted according to the different properties of different display panels or different usage scenarios for the same display panel, to effectively reduce effect of the brightness saturation.

Further, the method of adjusting the drive signal further includes steps of: when it is determined that the average drive signal is higher than the first adaptive threshold of the corresponding color sub-pixel and lower than the second adaptive threshold of the corresponding color sub-pixel, decreasing the drive signals of the corresponding color sub-pixel lower than the average drive signal, by a second preset value. The second preset value is:

$$\text{Rave_1}=k*X1/(n-k)$$

where Rave_1 is the second preset value, k is a number of the drive signals higher than the average drive signal, in the corresponding color sub-pixels; wherein X1 is the first preset value, and n is a number of the drive signals of the corresponding color sub-pixels. It is to be noted that, the drive signal usually corresponds to a sub-pixel, so n is the number of the corresponding color sub-pixel.

The red sub-pixel is taken as example. When it is determined that the first average drive signal is higher than the first adaptive threshold of the red sub-pixel and lower than the second adaptive threshold of red sub-pixel, the drive signal of each red sub-pixel lower than the first average drive signal, is decreased by the second preset value. In the red sub-pixel, the drive signals of remaining red sub-pixels other than the first k red sub-pixels are respectively adjusted according to following equations:

$$R'(k+1)=R(k+1)-\text{Rave_1}, R'(k+2)=R(k+2)-\text{Rave_1}, \ldots, R'(i,j)=R(i,j)-\text{Rave_1}$$

wherein R'(k+1), R'(k+2), . . . , R'(i,j) are the adjusted drive signal. Above-mentioned signal processing can maintain the brightness of all red sub-pixels of the sub-pixel set to be constant.

As shown in FIG. 7, when the first average drive signal is higher than the first threshold RN and lower than the second threshold RM, before adjusted, each red sub-pixel of the sub-pixel set lower than the first average drive signal has more serious brightness saturation under the large view angle, that is, a part of the red sub-pixels are located the interval RII, or close to the interval RII. In this embodiment, the drive signal of each of these red sub-pixels is decreased by the second preset value, so that the drive signals of the red sub-pixels can be adjusted into the interval RIII or close to interval RIII, and the brightness-versus-drive-signal curve can have higher linear resolution under the large view angle, thereby improving the brightness contrast between the red sub-pixels, and enabling the brightness-versus-drive-signal curve to vary more linearly.

Further, the method of adjusting the drive signal further includes a step of: decreasing the drive signal of each of the corresponding color sub-pixels, higher than the average drive signal, by a third preset value when it is determined that the average drive signal is lower than the first adaptive threshold of the corresponding color sub-pixel.

The red sub-pixel is still taken as example. The red sub-pixels are arranged in a sequential order according to magnitudes of the drive signals, from high to low, R1≥R2≥R3≥ . . . ≥R_i,j, wherein R1, R2, . . . , R_i,j indicate the drive signals corresponding to the red sub-pixels. Suppose that the drive signals of the first k red sub-pixels all are higher than the first average drive signal, the drive signals of the first k red sub-pixels are adjusted according to following equations:

$$R'1=R1-X2, R'2=R2-X2, \ldots, R'k=Rk-X2$$

Wherein X2 is the third preset value, and R'1, R'2, . . . , R'k are the k adjusted drive signals.

As shown in FIG. 7, when the first average drive signal is lower than the first threshold RN, before adjusted, the red sub-pixel higher than the first average drive signal in the sub-pixel set has more serious the brightness saturation under the large view angle, that is, a part of the red sub-pixels are located the interval RII, or close to the interval RII. In this embodiment, the drive signal of each of these red sub-pixels are decreased by the third preset value, so as to increase linear resolutions of the brightness-versus-drive-signal curves of the red sub-pixels, and improve the brightness contrast between the red sub-pixels.

Specifically, the third preset value must satisfy a condition that the maximum drive signal of the drive signals of the color sub-pixels minus the third preset value is lower than the first threshold corresponding to the color sub-pixel. In this case, the drive signals of the corresponding color sub-pixels in the sub-pixel set can be adjusted to move into the RI interval. Furthermore, the third preset value can be adjusted according to different properties of the different display panels or different usage scenarios for the same display panel, so as to reduce the effect of brightness saturation.

Furthermore, the method of adjusting the drive signal further includes a step of: increasing the drive signals of the corresponding color sub-pixels lower than the average drive signal, by a fourth preset value when it is determined that the average drive signal is lower than the first adaptive threshold of the corresponding color sub-pixel. The fourth preset value is: Rave_2=k*X2/(n−k), wherein Rave_2 is the fourth preset value, and k is a number of the drive signals higher than the average drive signal, in the corresponding color sub-pixels; wherein X2 is the third preset value, and n is a number of the drive signals of the corresponding color sub-pixels.

In these red sub-pixels, the drive signals of remaining sub-pixels other than the first k red sub-pixels are respectively adjusted according to following equations:

$$R'(k+1)=R(k+1)+\text{Rave_2}, R'(k+2)=R(k+2)+\text{Rave_2}, \ldots, R'(i,j)=R(i,j)+\text{Rave_2}$$

Above-mentioned signal processing can maintain the brightness of all red sub-pixels in the sub-pixel set to be constant.

Furthermore, after the drive signals of the corresponding color sub-pixels lower than average drive signal is increased by the fourth preset value, the drive signals can still be located relatively lower positions within the interval lower than the first threshold, so that the brightness-versus-drive-signal curve can still vary linearly under the large view angle, and the contrast property of the pixels may not be affected by the view angle.

Further, the method of adjusting the drive signal further includes a step of: decreasing the drive signal of each of the corresponding color sub-pixels higher than the average drive signal, by a fifth preset value when it is determined that the average drive signal is higher than the second adaptive threshold of the corresponding color sub-pixels.

The red sub-pixel is taken as example. The red sub-pixels are arranged in a sequential order according to magnitudes of the drive signals, from high to low, R1≥R2≥R3≥ . . . ≥R_i,j, and R1, R2, . . . ,R_i,j indicates the drive signals of the red sub-pixels in the red sub-pixel. Suppose that the drive signals of the first k red sub-pixels are higher than the first average drive signal, the drive signals of the k red sub-pixels are adjusted according to following equations:

$$R'1=R1-X3, R'2=R2-X3, \ldots, R'k=Rk-X3$$

wherein X3 is the fifth preset value, and R'1, R'2, . . . , R'k are the first k adjusted drive signals.

As shown in FIG. 7, in a condition that the first average drive signal is higher than the second threshold RM, after the drive signal of each of red sub-pixels of the sub-pixel set higher than the first average drive signal is decreased by the fifth preset value, the brightness-versus-drive-signal curve can vary more linearly, and the adjusted drive signals are still located within the area of high drive signal, so that the brightness-versus-drive-signal curves of these red sub-pixels can have higher linear resolutions under the large view angle, thereby improving the contrast between brightness between the red sub-pixels.

Further, the method of adjusting the drive signal further includes a step of: increasing the drive signals of the corresponding color sub-pixels lower than the average drive signal, by a sixth preset value when it is determined that the average drive signal is higher than the second adaptive threshold of the corresponding color sub-pixels. The sixth preset value is:

$$\text{Rave_3}=k*X3/(n-k)$$

wherein Rave_3 is the sixth preset value, and k is a number of the drive signals of higher than the average drive signal, in the corresponding color sub-pixels; wherein X1 is the fifth preset value, and n is a number of the drive signals of the corresponding color sub-pixels.

In the red sub-pixel, the drive signals of remaining red sub-pixels other than the first k red sub-pixels are respectively adjusted according to following equations:

$$R'(k+1)=R(k+1)+\text{Rave_3}, R'(k+2)=R(k+2)+\text{Rave_3}, \ldots, R'(i,j)=R(i,j)+\text{Rave_3}$$

wherein R'(k+1), R'(k+2), . . . , R'(i,j) are the adjusted drive signals. The signal processing can maintain the brightness of all red sub-pixels of the sub-pixel set to be constant.

Furthermore, after the drive signals of the corresponding color sub-pixels lower than average drive signal is increased by the fourth preset value, and the adjusted drive signal can be still located at relatively higher positions of the interval between the first threshold and the second threshold, such as the higher positions within the interval RII, so that the brightness-versus-drive-signal curve can vary linearly under the large view angle, thereby improving the brightness contrast between the red sub-pixels.

Figure 3:
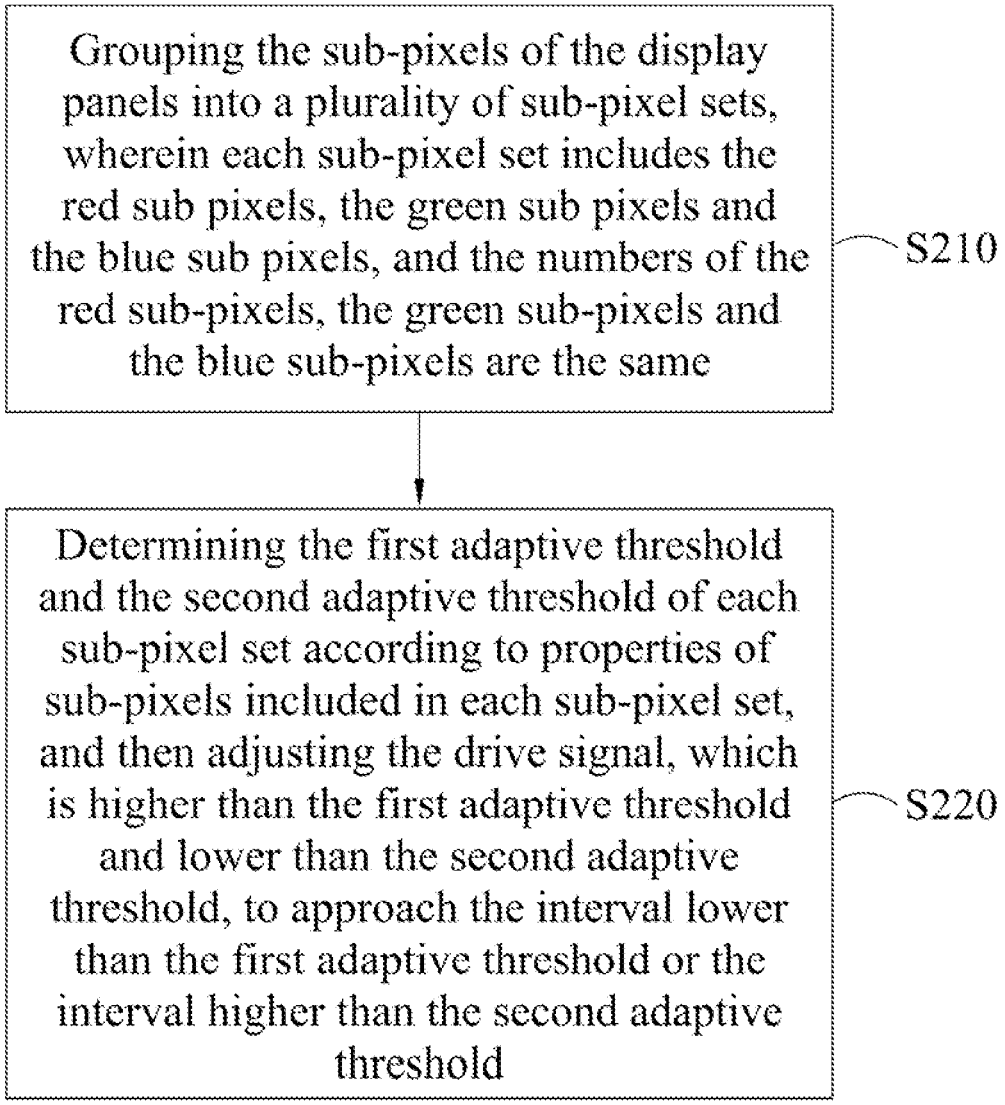
FIG. 3 is a flowchart showing an operation of an embodiment of step S200 of the driving method of the display panel of FIG. 2.
Figure 6:
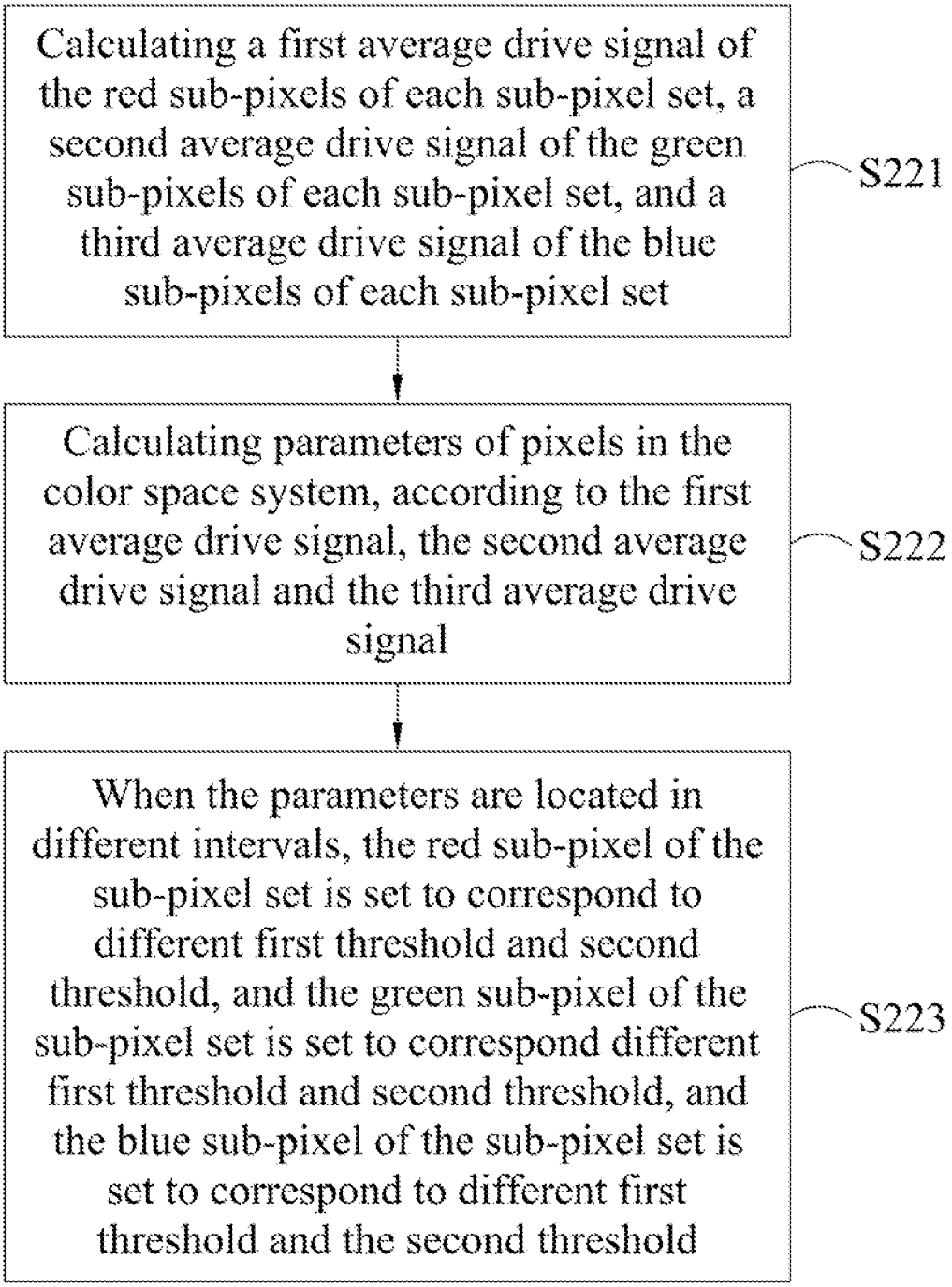
FIG. 6 is a flowchart showing an operation of an embodiment of step S220 of FIG. 3.

FIGS. 2, 3 and 6 are flowcharts of the driving method of the embodiment of the present disclosure. It is to be noted that steps in a flowchart showing in FIGS. 2, 3 and 6 are displayed with arrowhead indication, but it is not necessary to execute these steps in the sequential order indicated by arrowhead, that is, execution order of these steps are not limited, unless the context clearly indicates otherwise. These steps can be executed in other sequential order. Furthermore, at least a part of steps of FIGS. 2, 3, and 6 can include a plurality of sub-steps or stages, and it is not necessary to execute and complete sub-steps or stages at the same time. These steps can be executed at different times, and the steps is not necessary to be executed step by step, other steps or s at least a part of sub-steps or stages of other steps can be executed sequentially or alternatively.

Those skilled in the art would realize that all flows or a part of flows of the driving method of aforementioned embodiments can be implemented by using computer program to control hardware, and the computer program can be stored in a computer readable storage media. The process executed by the program can include the flow of the method aforementioned embodiment. Preferably, the storage media can be a disk, an optical disk, or read-only memory (ROM). The computer program can be executed by a processor to perform above-mentioned driving method of the display panel.

It is to be noted that, the principle of the function executed by the processor is the same as that of above-mentioned driving method of the display panel, so detailed description is not repeated.

Figure 11:
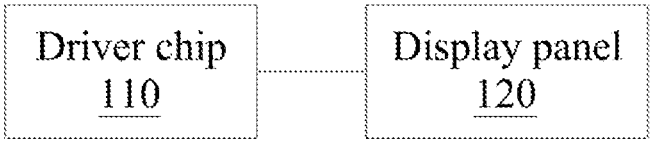
FIG. 11 is a block diagram of a display device of other embodiment of the present disclosure.

Please refer to FIG. 11, which shows other embodiment providing a display device. The display device includes a driver chip 110 and a display panel 120. Within luminance-versus-signal curve under the side view angle of the display panel 120, when drive signal is lower than the first threshold, higher than the second threshold, or between the first threshold and the second threshold respectively, the slope of the tangent line is higher than the preset slope threshold, higher than the preset slope threshold, or lower than the preset slope threshold.

The driver chip 110 is configured to obtain drive signals of sub-pixels on the display panel 120, and set the first adaptive threshold and the second adaptive threshold according to the properties of the sub-pixels, and then adjusting the drive signal, which is higher than the first adaptive threshold and lower than the second adaptive threshold, to approach the interval lower than the first adaptive threshold or the interval higher than the second adaptive threshold.

It is to be noted that, the function of the driver chip 110 of the display device provided in this embodiment can be performed according to the principle the same as that of driving method of display panel of other embodiment, so detailed description is not repeated.

Preferably, the display device can be LCD display device, OLED display device, LED display device, curved display device or the like.

The present disclosure disclosed herein has been described by means of specific embodiments. However, numerous modifications, variations and enhancements can be made thereto by those skilled in the art without departing from the spirit and scope of the disclosure set forth in the claims.

What is claimed is:

1. A driving method of a display panel, wherein according to a luminance-versus-drive-signal curve under a side view angle of the display panel, when a drive signal is lower than a first adaptive threshold, higher than a second adaptive threshold, or between the first adaptive threshold and the second adaptive threshold, respectively, a slope of a tangent line on the luminance-versus-drive-signal curve is higher than a preset slope threshold, higher than the preset slope threshold, or lower than the preset slope threshold, the driving method comprising:

obtaining the drive signal of each of sub-pixels on the display panel;

determining the first adaptive threshold and the second adaptive threshold according to properties of the sub-pixels; adjusting the drive signal higher than the first adaptive threshold and lower than the second adaptive threshold to approach an interval lower than the first adaptive threshold or an interval higher than the second adaptive threshold;

grouping the sub-pixels of the display panels into a plurality of sub-pixel sets, wherein each sub-pixel set comprises the red sub-pixels, the green sub-pixels and the blue sub-pixels, and the numbers of the red sub-pixels, the green sub-pixels and the blue sub-pixels are the same; and determining the first adaptive threshold and the second adaptive threshold according to properties of the sub-pixels included in each sub-pixel set, and adjusting the drive signal higher than the first adaptive threshold and lower than the second adaptive threshold, to approach the interval lower than the first adaptive threshold or the interval higher than the second adaptive threshold.

2. The driving method according to claim 1, wherein the step of determining the first adaptive threshold and the second adaptive threshold according to the properties of the sub-pixels of each sub-pixel set, further comprises:

respectively calculating a first average drive signal of red sub-pixels, a second average drive signal of green sub-pixels, and a third average drive signal of blue sub-pixels in each sub-pixel set; and calculating parameters of the sub-pixel set in a color space system according to the first average drive signal, the second average drive signal and the third average drive signal; and when the parameters are located in different intervals, determining different first adaptive thresholds and second adaptive thresholds of the red sub-pixels of the sub-pixel set, determining different first adaptive thresholds and second adaptive thresholds of the green sub-pixels of the sub-pixel set, and determining different first adaptive thresholds and second adaptive thresholds of the blue sub-pixels of the sub-pixel set.

3. The driving method according to claim 2, wherein the parameters comprise values of saturation and hue.

4. The driving method according to claim 3, wherein a value of hue is divided into six different intervals, and the first interval is: $0° < H \leq 45°$ and $315° < H \leq 360°$, the second interval is: $45° < H \leq 135°$, the third interval is: $135° < H \leq 205°$, the fourth interval is: $205° < H \leq 245°$, the fifth interval is: $245° < H \leq 295°$, and the sixth interval is: $295° < H \leq 315°$, wherein H is the value of hue.

5. The driving method according to claim 2, wherein the step of adjusting the drive signal higher than the first adaptive threshold and lower than the second adaptive threshold, to approach the interval lower than the first adaptive threshold or the interval higher than the second adaptive threshold, further comprises increasing the drive signal higher than the average drive signal by a first preset value, when it is determined that the average drive signal is higher than the first adaptive threshold of the corresponding color sub-pixel and lower than the second adaptive threshold of the corresponding color sub-pixel, wherein the average drive signal is the first average drive signal when the corresponding color sub-pixel is the red sub-pixel, the average drive signal is the second average drive signal when the corresponding color sub-pixel is the green sub-pixel, and the average drive signal is the third average drive signal when the corresponding color sub-pixel is the blue sub-pixel.

6. The driving method according to claim 5, wherein the first preset value satisfies a condition that the minimum drive signal among the drive signals higher than the average drive signals plus the first preset value is higher than the second threshold of the color sub-pixel.

7. The driving method according to claim 5, wherein the step of adjusting the drive signal higher than the first adaptive threshold and lower than the second adaptive threshold to approach to the interval lower than the first adaptive threshold or the interval higher than the second adaptive threshold, further comprises decreasing the drive signals of the corresponding color sub-pixel lower than the average drive signal by a second preset value when it is determined that the average drive signal is higher than the first adaptive threshold of the corresponding color sub-pixel and lower than the second adaptive threshold of the corresponding color sub-pixel, wherein the second preset value is: $Rave_1 = k*X1/(n-k)$, wherein Rave_1 is the second preset value, and k is a number of the drive signals higher than the average drive signal in the corresponding color sub-pixels, and wherein X1 is the first preset value, and n is a number of the drive signals of the corresponding color sub-pixels.

8. The driving method according to claim 5, wherein the step of adjusting the drive signal higher than the first adaptive threshold and lower than the second adaptive threshold to approach the interval lower than the first adaptive threshold or the interval higher than the second adaptive threshold, further comprises decreasing the drive signal of each of the corresponding color sub-pixels higher than the average drive signal by a third preset value, when it is determined that the average drive signal is lower than the first adaptive threshold of the corresponding color sub-pixel.

9. The driving method according to claim 8, wherein the third preset value satisfies a condition that the maximum drive signal among the drive signals of the color sub-pixels minus the third preset value is lower than the first threshold of the color sub-pixel.

10. The driving method according to claim 8, wherein the step of adjusting the drive signal higher than the first adaptive threshold and lower than the second adaptive threshold to approach the interval lower than the first adaptive threshold or the interval higher than the second adaptive threshold, further comprises: increasing the drive signals of the corresponding color sub-pixels lower than the average drive signal by a fourth preset value when it is determined that the average drive signal is lower than the second adaptive threshold of the corresponding color sub-pixel, wherein the fourth preset value is: $Rave_2=k*X2/(n-k)$, wherein Rave_2 is the fourth preset value, and k is a number of the drive signals higher than the average drive signal in the corresponding color sub-pixels, and wherein X2 is the third preset value, and n is a number of the drive signals of the corresponding color sub-pixels.

11. The driving method according to claim 5, wherein the step of adjusting the drive signal higher than the first adaptive threshold and lower than the second adaptive threshold to approach the interval lower than the first adaptive threshold or the interval higher than the second adaptive threshold, further comprises decreasing the drive signal of each of the corresponding color sub-pixels higher than the average drive signal by a third preset value, when it is determined that the average drive signal is higher than the second adaptive threshold of the corresponding color sub-pixels.

12. The driving method of according to claim 11, wherein the step of adjusting the drive signal higher than the first adaptive threshold and lower than the second adaptive threshold to approach the interval lower than the first adaptive threshold or the interval higher than the second adaptive threshold, further comprises increasing the drive signals of the corresponding color sub-pixels lower than the average drive signal by a sixth preset value when it is determined that the average drive signal is higher than the second adaptive threshold of the corresponding color sub-pixels, wherein the sixth preset value is: $Rave_3=k*X3/(n-k)$, wherein Rave_3 is the sixth preset value, and k is a number of the drive signals higher than the average drive signal, in the corresponding color sub-pixels, and wherein X3 is the fifth preset value, and n is a number of the drive signals of the corresponding color sub-pixels.

13. A display device, comprising:

a display panel, wherein according to a luminance-versus-drive-signal curve under a side view angle of the display panel, when the drive signal is lower than a first threshold, higher than a second threshold, or between the first threshold and the second threshold, respectively, the slope of the tangent line is higher than the preset slope threshold, higher than the preset slope threshold, or lower than the preset slope threshold; and a driver chip configured to: obtain the drive signal of each of sub-pixels on the display panel; determine a first adaptive threshold and a second adaptive threshold according to properties of the sub-pixels; adjust the drive signal higher than the first adaptive threshold and lower than the second adaptive threshold to approach the interval lower than the first adaptive threshold or the interval higher than the second adaptive threshold;

group the sub-pixels of the display panels into a plurality of sub-pixel sets, wherein each sub-pixel set comprises the red sub-pixels, the green sub-pixels and the blue sub-pixels, and the numbers of the red sub-pixels, the green sub-pixels and the blue sub-pixels are the same;

respectively calculate a first average drive signal of red sub-pixels, a second average drive signal of green sub-pixels, and a third average drive signal of blue sub-pixels in each sub-pixel set;

calculate parameters of the sub-pixel set in a color space system according to the first average drive signal, the second average drive signal and the third average drive signal;

when the parameters are located in different intervals, determine different first adaptive thresholds and second adaptive thresholds of the red sub-pixels of the sub-pixel set, determine different first adaptive thresholds and second adaptive thresholds of the green sub-pixels of the sub-pixel set, and determine different first adaptive thresholds and second adaptive thresholds of the blue sub-pixels of the sub-pixel set, wherein the parameters comprise values of saturation and hue; and increasing the drive signal higher than the average drive signal by a first preset value, when it is determined that the average drive signal is higher than the first adaptive threshold of the corresponding color sub-pixel and lower than the second adaptive threshold of the corresponding color sub-pixel, wherein the average drive signal is the first average drive signal when the corresponding color sub-pixel is the red sub-pixel, the average drive signal is the second average drive signal when the corresponding color sub-pixel is the green sub-pixel, and the average drive signal is the third average drive signal when the corresponding color sub-pixel is the blue sub-pixel.

* * * * *